US008146468B1

(12) United States Patent
Kachelries

(10) Patent No.: US 8,146,468 B1
(45) Date of Patent: Apr. 3, 2012

(54) DEVICE AND METHOD FOR COMPRESSING AND CUTTING SOFT FOOD

(76) Inventor: Wayne J. Kachelries, Morrisville, PA (US)

( * ) Notice: Subject to any disclaimer, the term of this patent is extended or adjusted under 35 U.S.C. 154(b) by 512 days.

(21) Appl. No.: 12/348,263

(22) Filed: Jan. 2, 2009

(51) Int. Cl.
*B26D 3/18* (2006.01)
*B26D 1/553* (2006.01)

(52) U.S. Cl. ..... 83/13; 83/651.1; 83/620; 99/537; 30/117; 30/305

(58) Field of Classification Search ..... 30/114–117, 30/303, 305; D7/672, 673; 99/537; 83/138, 83/307.1–307.3, 435.15, 466.1, 569, 651.1, 83/761, 762
See application file for complete search history.

(56) References Cited

U.S. PATENT DOCUMENTS

| | | | | | |
|---|---|---|---|---|---|
| 512,080 | A | * | 1/1894 | Winter | 425/308 |
| 689,687 | A | * | 12/1901 | Newcome | 30/287 |
| 915,935 | A | * | 3/1909 | Carmichawl et al. | 30/117 |
| 1,442,762 | A | * | 1/1923 | Du Buque | 83/647 |
| 1,445,787 | A | * | 2/1923 | Meyers | 83/613 |
| 1,448,938 | A | * | 3/1923 | Parrott | 83/762 |
| 1,565,846 | A | * | 12/1925 | Cantey | 83/581.1 |
| 1,653,578 | A | * | 12/1927 | Ludwig | 83/624 |
| 1,656,415 | A | * | 1/1928 | Breitkrentz | 83/620 |
| 1,714,494 | A | * | 5/1929 | Case | 83/613 |
| 1,952,033 | A | * | 3/1934 | Wittstein | 83/609 |
| 2,111,035 | A | * | 3/1938 | Winslow | 30/117 |
| 2,114,277 | A | * | 4/1938 | Bloomfield | 30/117 |
| 2,537,505 | A | * | 1/1951 | Baran | 30/2 |
| 2,649,658 | A | * | 8/1953 | Nelson | 83/761 |
| 2,716,814 | A | * | 9/1955 | Lerner | 30/115 |
| 3,354,546 | A | * | 11/1967 | Pagliuca | 83/563 |
| 4,771,681 | A | * | 9/1988 | Nagata | 99/483 |
| 4,920,844 | A | * | 5/1990 | Nagata | 83/404.3 |
| D308,803 | S | * | 6/1990 | Horton et al. | D7/673 |
| D375,661 | S | * | 11/1996 | Ross et al. | D7/673 |
| 5,752,434 | A | * | 5/1998 | Kuan | 99/495 |
| 6,276,918 | B1 | * | 8/2001 | Slaughter et al. | 425/289 |
| D540,628 | S | | 4/2007 | Meyers et al. | |
| 2006/0093716 | A1 | * | 5/2006 | Wu | 426/518 |
| 2009/0035443 | A1 | * | 2/2009 | Kojima | 426/634 |
| 2009/0078100 | A1 | * | 3/2009 | Repac | 83/425.3 |

FOREIGN PATENT DOCUMENTS

WO WO2007/101705 * 9/2007

* cited by examiner

*Primary Examiner* — Laura M. Lee
(74) *Attorney, Agent, or Firm* — LaMorte & Associates P.C.

(57) ABSTRACT

A device and method of cutting soft food material. The cutting is performed by an arrangement of cutting wire or ribbon that is pulled taut across a supporting frame. The cuts are made while the food material is lightly compressed and confined in a press. The press consists of a compression chamber having a bottom surface. The cutter is placed at the bottom of the compression chamber. Food material is then placed into the compression chamber atop the cutter. A compression plate is placed over the food material. The compression plate is pressed down to compress the food material. The compression squeezes the food material and liberates any excess fluids that may be present within the food material. This conditions the food material. The cutter is then pulled through the conditioned food.

13 Claims, 4 Drawing Sheets

DEVICE AND METHOD FOR COMPRESSING AND CUTTING SOFT FOOD

BACKGROUND OF THE INVENTION

1. Field of the Invention

In general, the present invention relates to food presses and cutting presses that are used to compress and cut food, respectively. More particularly, the present invention relates to manually operated devices that are used to squeeze and cut soft food, such as tofu.

2. Prior Art Description

Tofu is made from lightly compressed and aged soy bean curd. As such, tofu has a gelatinous consistency with a high moisture content. In order to keep tofu from drying out, it is often packaged in a liquid, such as water or soy whey.

The problem associated with liquid packaged tofu is that the tofu is saturated with the surrounding liquid. The tofu, therefore, has very little capacity to absorb other liquids and other flavors when it is used in cooking.

To remedy this problem, tofu is typically conditioned prior to use. Some of the liquid saturating the tofu is removed so that the tofu has the ability to absorb flavors during cooking. Often the tofu is wrapped in a towel that absorbs some of the liquids within the tofu. Sometimes, tofu is placed in a press so that some of the liquid in the tofu can be squeezed out of the tofu. Prior art presses are exemplified by U.S. Design Pat. No. D540,628 to Meyers, entitled Tofu Press.

Due to the gelatinous nature of tofu, it can be only lightly compressed before it deforms out of shape. It is for this reason that tofu presses are commonly made with rectangular compression chambers. This enables a piece of tofu to be cut to size and precisely placed in the press. Since the press and the tofu are both equal in size, the tofu cannot laterally deform when compressed.

Presses compress the tofu to remove excess liquids. As a block of tofu is compressed, the block of tofu becomes slightly thinner as liquid is freed from the tofu. The compression of the tofu better bonds the molecules of the tofu by eliminating some of the water molecules that are in the tofu. This makes the tofu more durable and easier to cut. Tofu can therefore be lightly compressed to preserve the softness of the tofu for dishes like salads. Conversely, tofu can be heavily pressed for firmer tofu for heartier dishes.

When cooking, a block of tofu is typically cut into small pieces. The cutting is typically done manually by a person using a knife. It takes a sharp knife and skill to cleanly cut a soft block of tofu. Recognizing that not all people have the skills or the tools to correctly cut tofu by hand, devices have been developed specifically for cleanly cutting blocks of tofu. Such devices typically consist of a block form that holds the tofu in shape and a wire or ribbon cutter that passes through the tofu. Such devices are most prevalent in Japan and are exemplified by Japanese Patent Publication No. 11076057A, entitled Tofu Cutter and Tofu Fixer, Japanese Patent Publication No. 01193192A, entitled Tofu Cutting And Transfer Device, Japanese Patent Publication No. 02186957A, entitled Automatic Cutting And Packaging Device for Tofu, and Japanese Patent Publication No. 09131696A entitled Tofu Cutting Device.

Such prior art tofu cutting devices cut the tofu while the tofu is relaxed and not under compression. Furthermore, the cuts created by such prior art devices are only in one plane. If a block of tofu is to be cut in two planes, it must be removed, turned, reinserted and recut.

Repositioning cut tofu is a very difficult task. Likewise, tofu can be cut more efficiently and neatly if it is cut while compressed rather than after compression. A need therefore exists for a device that would enable a block of tofu, or similar material, to be pressed and cut while compressed. A need also exists for a device that can cut a block of tofu or similar material in more than one plane without having to reposition the tofu. These needs are met by the present invention as described and claimed below.

SUMMARY OF THE INVENTION

The present invention is a device and method of cutting soft food material. The cutting is performed by a cutter made from cutting wire or ribbon that is pulled taut across a supporting frame. To ensure that the cutter cleanly cuts the food material, the cuts are made while the food material is lightly compressed and confined in a press.

The press consists of a compression chamber having a bottom surface. The cutter is placed at the bottom of the compression chamber. Food material is then placed into the compression chamber atop the cutter. A compression plate is placed over the food material. The compression plate is pressed down to compress the food material. The compression squeezes the food material and liberates any excess fluids that may be present within the food material. This conditions the food material. The cutter is then pulled through the conditioned food material to make vertical cuts.

Horizontal cuts can be created in the conditioned food material. To create the horizontal cuts, the compression plate and the vertical cutter are removed. A second horizontal cutter is then introduced into the compression chamber and moved laterally across the compression chamber to create the horizontal cuts.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention food preparation device can be used to press and cut many soft food products, such as balls of mozzarella cheese, the present invention is especially well suited for cutting at least one block of tofu. Accordingly, the exemplary embodiment of the invention is illustrated and described in an application where it is being used to press and cut at least one block of tofu. Such an application is merely exemplary and is provided to set forth the best mode of use contemplated for the invention. However, the present invention food preparation device can press and cut materials other than tofu and its application to tofu should not be considered a limitation on the claims.

Figure 1:
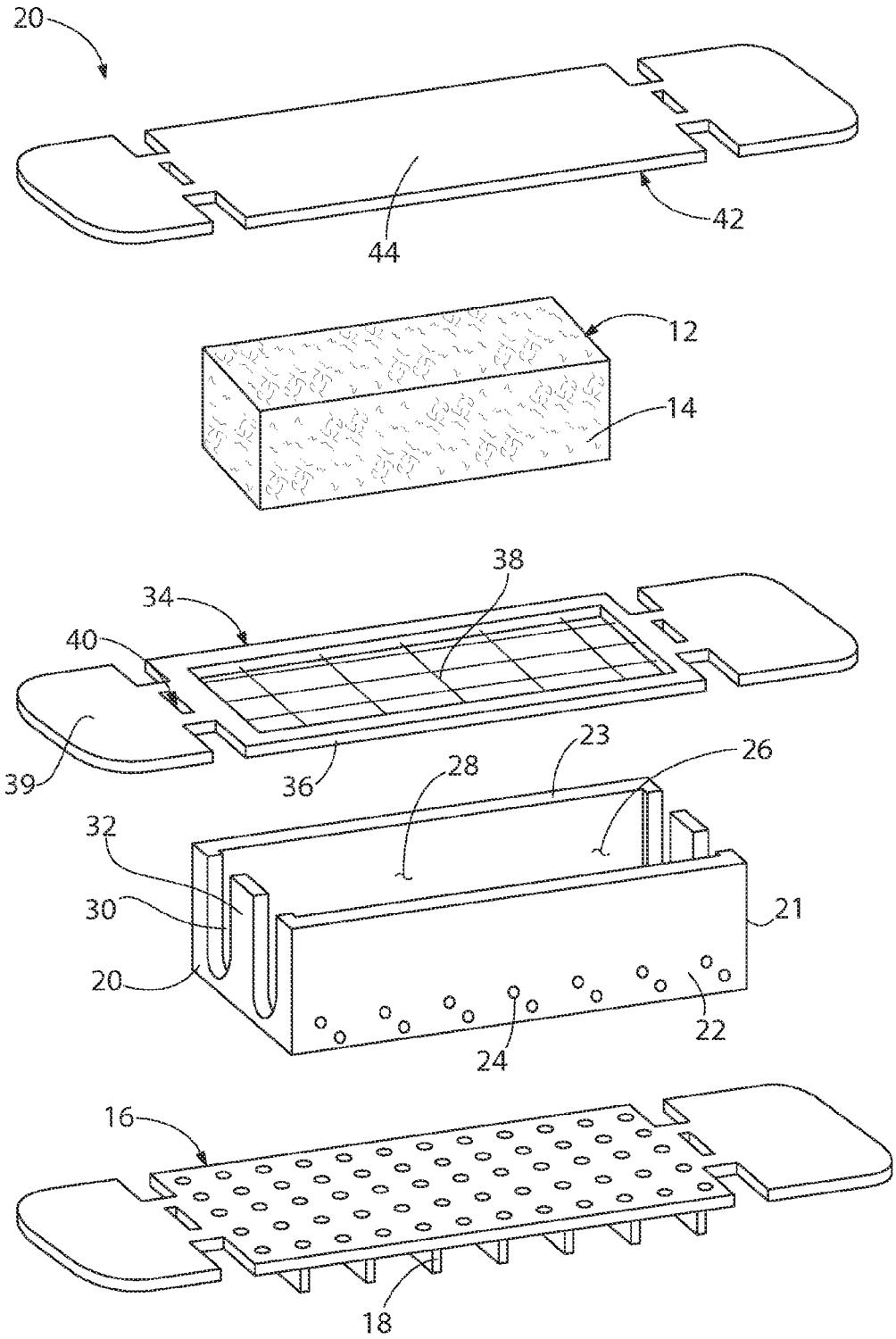
FIG. 1 is an exploded view of an exemplary embodiment of a food preparation device.

Referring to FIG. 1, a food preparation device 10 for compressing and cutting food material 12 is shown. As previously mentioned, the exemplary food material 12 is a block of tofu 14. The food preparation device 10 includes a base plate 16. The base plate 16 is preferably perforated so that liquid can flow through the structure of the base plate 16. The base plate 16 has a periphery. In the shown embodiment, the periphery is rectangular, however, any other geometric shape can be chosen.

Supports 18 may be provided on the underside of the base plate 16. The supports 18 hold the base plate 16 above any underlying surface, thereby ensuring good drainage through the perforated base plate 16.

Vertical sidewalls 20, 21, 22, 23 extend upwardly from the periphery of the base plate 16. Since the periphery of the base plate 16 is rectangular, four sidewalls 20, 21, 22, 23 are present. The sidewalls 20, 21, 22, 23 may be interconnected, such as is illustrated. However, such an interconnection is not required. One or more of the sidewalls 20, 21, 22, 23 may also contain perforations 24 to enable liquid to flow through the structure of the sidewalls 20, 21, 22, 23.

The base plate 16 and the sidewalls 20, 21, 22, 23 define the bottom and sides of a compression chamber 26. The compression chamber 26 has an open top 28. At least two of the sidewalls 20, 21 of the compression chamber 26 are parallel and are positioned on opposite sides of the compression chamber 26. Vertical slots 30 are formed in the opposing sidewalls 20, 21. The presence of the vertical slots 30 define at least one vertical guide rail 32 in each of the sidewalls 20, 21. In the shown embodiment, each opposing sidewall 20, 21 contains two vertical slots 30. The vertical slots 30 define a single guide rail 32. However, as will later be understood, any plurality of slots 30 and guide rails 32 can be used.

A vertical cutter 34 is provided. The vertical cutter 34 consists of a frame 36 and cutting elements 38 that are pulled taut between different sections of the frame 36. The cutting elements 38 can be wires or flat ribbons on edge. The number, position, and spacing of the cutting elements 38 are a matter of design choice.

Handles 39 extend from the frame 36. Slits 40 are formed in the frame 36 proximate the handles 39. The slits 40 are shaped and sized to receive the guide rails 32 in the sidewalls 20, 21. The handles 39 extend from the frame 36 on the outside of the compression chamber 26. The guide rails 32 pass through the slits 40. The vertical cutter 34 is therefore free to move only straight up and down. The movement of the vertical cutter 34 is controlled by applying upward or downward forces to the handles 39. As the handles 39 outside the compression chamber 26 are moved up and down, the cutting elements 38 within the compression chamber 26 also move up and down.

A compression plate 42 is also provided. The compression plate 42 is shaped very similarly to the vertical cutter 34 except that the center section 44 of the compression plate 42 is solid. The compression plate 42 has slits 46 that receive the guide rails 32 formed in the opposing sidewalls 20, 21. The compression plate 42 contains handles 48 that extend outwardly.

The center section 44 of the compression plate 42 passes into the compression chamber 26. The handles 48 extend outside the compression chamber 26. As the handles 48 are manually moved up and down, the center section 44 of the compression plate 42 moves up and down within the compression chamber 26.

Figure 2:
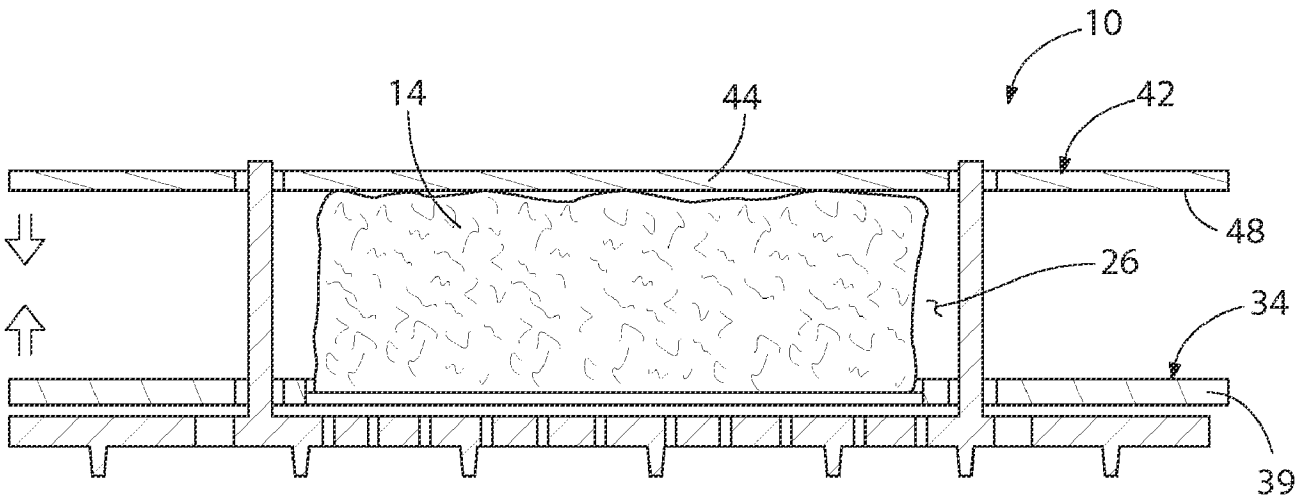
FIG. 2 is a cross-sectional view of the embodiment of FIG. 1 shown in conjunction with a block of food material.

Referring to FIG. 2 in conjunction with FIG. 1, it will be understood that in order to use the food preparation device 10, the vertical cutter 34 is set into the bottom of the compression chamber 26. A block of tofu 14 is then placed inside the compression chamber 26 atop the vertical cutter 34. Preferably, the block of tofu 14 has the same general peripheral shape as does the compression chamber 26.

Once the block of tofu 14 is inside the compression chamber 26, the compression plate 42 is advanced over the block of tofu 14. The block of tofu 14 is therefore interposed between the vertical cutter 34 and the center section 44 of the compression plate 42.

A person manually applies a downward force to the handles 48 of the compression plate 42. This compresses the block of tofu 14 within the compression chamber 26. After a predetermined degree of liquid has been squeezed from the block of tofu 14, a person can engage the handles 39 of the vertical cutter 34.

Figure 3:
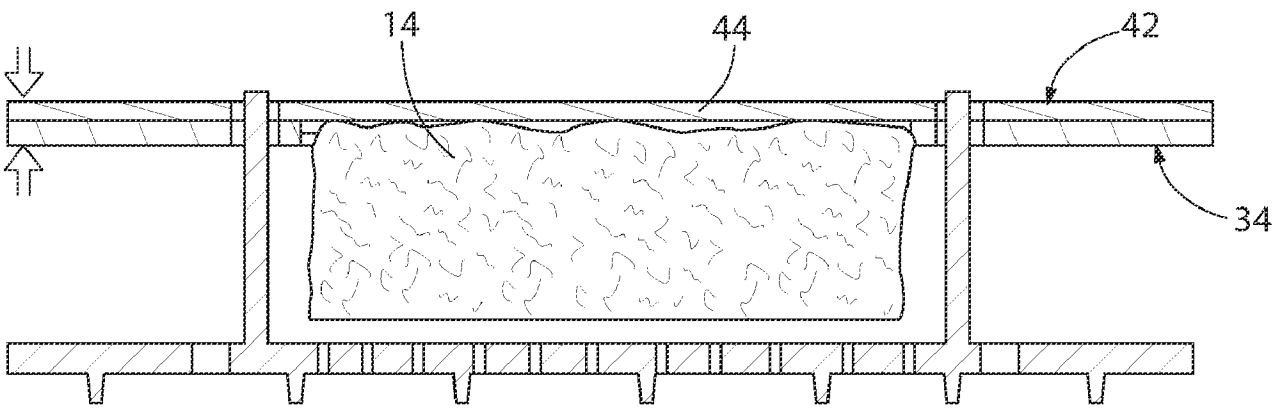
FIG. 3 is cross-sectional view showing the vertical cutter moving through the block of food material.

Referring to FIG. 3 in conjunction with FIG. 2, it can be seen that a person can squeeze the compression plate 42 and the vertical cutter 34 together. This maintains the compression force on the block of tofu 14 while the cutting elements 38 of the vertical cutting plate 34 are forced upwardly through the material of the block of tofu 14. As is indicated by FIG. 3, the cutting elements 38 pass through the block of tofu 14 and the vertical cutter 34 comes to rest in abutment with the compression plate 42. The block of tofu 14 is cut into segments and remains compressed between the base plate 16 and the compression plate 42. Compression forces are removed from the compression plate 42 and both the compression plate 42 and the vertical cutter 34 can be removed without disturbing the cut block of tofu 14. The result is a block of tofu 14 that is properly compressed and neatly cut with vertical cuts.

Figure 4:
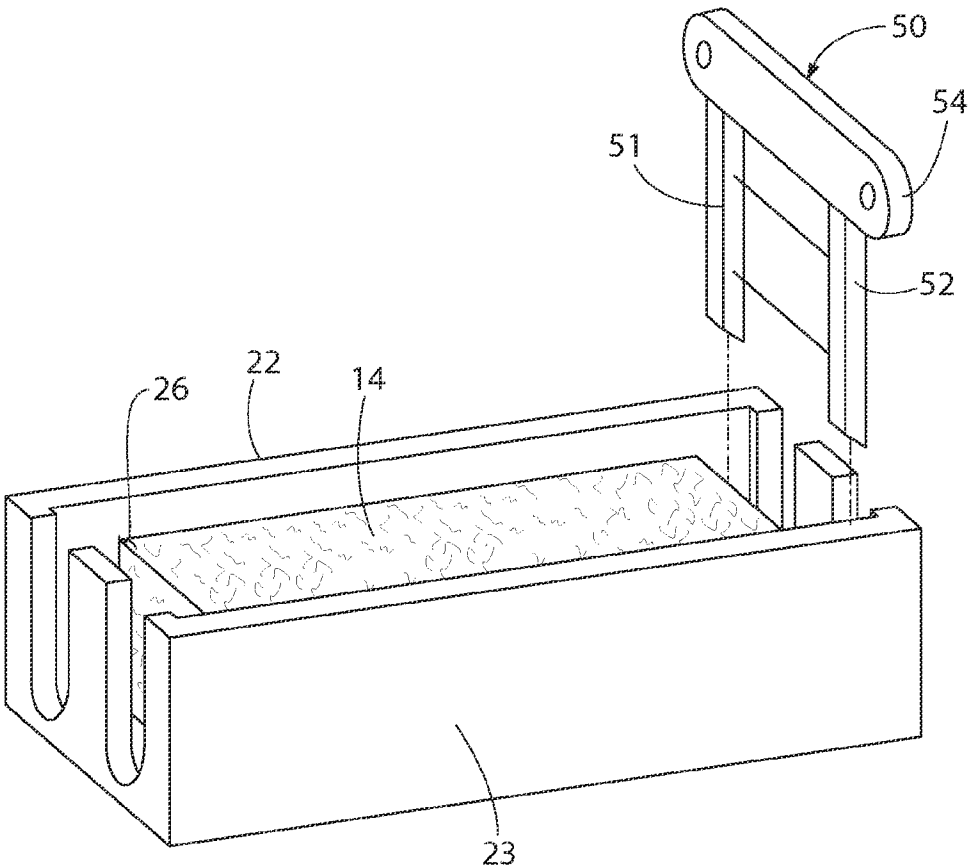
FIG. 4 is a perspective view showing an optional horizontal cutter.

Referring now to FIG. 4, an optional horizontal cutter 50 is shown. Once a block of tofu 14 has been pressed and cut vertically, the compression plate 42 (FIG. 3) and vertical cutter 34 (FIG. 3) are removed. This leaves the pressed and vertically cut block of tofu 14 in the open compression chamber 26. The block of tofu 14 remains compressed even once the compression plate 42 is removed. This is because the liquids that have been squeezed from the tofu 14 have been drained away and cannot be reabsorbed by the tofu 14.

Before the block of tofu 14 is removed from the compression chamber 26, horizontal cuts can be made through the block of tofu 14. The horizontal cuts are created by introducing the horizontal cutter 50 into the compression chamber 26.

The horizontal cutter 50 has two side arms 51, 52. The side arms 51, 52 extend from a common cross-handle 54. The two side arms 51, 52 are spaced so as to just fit within the compression chamber 26. The side arms 51, 52 may be anchored within the cross-handle 54. Alternatively, the cross-handle 54 may be adjustable in position up and down the length of the side arms 51, 52. In this manner, the distance that the side arms 51, 52 extend below the cross-handle 54 can be selectively controlled.

At least one cutting wire 56 extends between the side arms 51, 52 under the cross-handle 54. To utilize the horizontal cutter 50, the cross-handle 54 is adjusted on the side arms 51, 52 until the cutting wire 56 is at a desired distance from the cross-handle 54. The side arms 51, 52 and cutting wire 56 are placed at one end of the compression chamber 26. The side arms 51, 52 and cutting wire 56 are pushed into the compression chamber 26 until the cross-handle 54 contacts the top of the sidewalls 22, 23 of the compression chamber 26. Using manual manipulation, the cross-handle 54 is then pulled along the length of the compression chamber 26. The result is that at least one cutting wire 56 is pulled through the block of tofu 14 and at least one horizontal cut is produced.

The horizontal cutter 50 can be adjusted and drawn through the block of tofu 14 multiple times to produce multiple horizontal cuts.

It will be understood that the embodiment of the present invention that is illustrated and described is merely exemplary and that a person skilled in the art can make many variations to that embodiment. For instance, if the present invention were used to cut mozzarella balls rather than blocks of tofu, the compression chamber, compression plate, and cutters could be made round rather than rectangular. Furthermore, it will be understood that the compression plate and the cutters are guided by the structure of the compression chamber. Numerous slots, grooves, rails and the like can be incorporated into the invention to facilitate the free reciprocal movement of these components. All such embodiments are intended to be included within the scope of the present invention as defined by the claims.

What is claimed is:

1. A method of cutting soft food material, comprising the steps of:

providing a cutter having a frame and a plurality of cutting elements that tautly extend between sections of said frame;

providing a base plate;

providing a compression plate;

placing said frame of said cutter on said base plate, wherein said frame contacts said base plate and said plurality of cutting element are suspended across said base plate by said frame;

placing said food material onto said plurality of cutting elements atop said base plate;

placing said compression plate atop said food material, wherein said food material is interposed between said compression plate on one side and both said plurality of cutting elements and said base plate on an opposite side;

pressing said compression plate toward said base plate, therein compressing said food material there between; and moving said plurality of cutting elements through said food material while maintaining said food material in compression between said compression plate and said base plate, wherein said frame moves from contact with said base plate to contact with said compression plate.

2. The method according to claim 1, wherein said step of providing a cutter having a frame and a plurality of cutting elements includes providing a wire cutter wherein said plurality of cutting elements are wires.

3. The method according to claim 1, wherein said step of providing a base plate includes providing a compression chamber, wherein said base plate serves as a bottom surface of said compression chamber and wherein said compression chamber is defined, at least in part, by at least one side that extends upwardly from said base plate.

4. The method according to claim 3, wherein said step of providing a compression plate includes providing a plate that is sized to fit within said compression chamber.

5. The method according to claim 1, wherein said step of moving said plurality of cutting elements through said food material includes pulling said frame through said food material and into abutment with said compression plate.

6. The method according to claim 1, further including the step of providing perforations through said base plate for making said base plate pervious to liquids.

7. The method according to claim 6, further including the step of providing supports under said base plate for elevating said base plate.

8. The method according to claim 3, further including the steps of:

providing a second cutter;

advancing said second cutter through said food material in said compression chamber, therein producing at least one cut through said food material that is parallel to said base plate.

9. A method of cutting a block of tofu into smaller pieces, comprising the steps of:

providing a compression chamber having an open top, a bottom surface and at least one side wall that extends upwardly from said bottom surface to said open top;

providing a cutter having a frame and a plurality of cutting elements that tautly extend between sections of said frame, wherein said frame is sized to fit within said compression chamber and is free to move with said plurality of cutting elements up and down within said compression chamber;

providing a compression plate sized to fit into said compression chamber through said open top;

placing said frame and said plurality of cutting elements within said compression chamber;

placing said block of tofu within said compression chamber atop said plurality of cutting element and beneath said compression plate;

compressing said block of tofu between said compression plate and said bottom surface; and moving said cutter within said compression chamber to cut said block of tofu while maintaining said block of tofu in compression between said compression plate and said bottom surface; wherein said frame moves from contact with said base plate to contact with said compression plate.

10. The method according to claim 9, wherein said step of providing a cutter having a frame and a plurality of cutting elements includes providing a wire cutter wherein said plurality of cutting elements are wires.

11. The method according to claim 9, further including the step of providing perforations through said bottom surface for making said bottom surface pervious to liquids.

12. The method according to claim 9, further including the step of providing supports under said bottom surface for elevating said bottom surface.

13. The method according to claim 9, further including the steps of:

providing a second cutter;

advancing said second cutter through said block of tofu in said compression chamber, therein producing at least one cut through said block of tofu that is parallel to said bottom surface.

* * * * *